United States Patent [19]

Ota et al.

[11] Patent Number: 4,993,565

[45] Date of Patent: Feb. 19, 1991

[54] BIAXIAL-ORIENTATION BLOW-MOLDED BOTTLE-SHAPED CONTAINER HAVING OPPOSED RECESSES AND GROOVES FOR STABLE GRIPPING AND ANTI-BUCKLING STIFFNESS

[75] Inventors: Akiho Ota; Hiroichi Ishii, both of Koto, Japan

[73] Assignee: Yoshino Kogyosho Co., Ltd., Tokyo, Japan

[21] Appl. No.: 112,070

[22] Filed: Oct. 26, 1987

Related U.S. Application Data

[63] Continuation-in-part of Ser. No. 851,450, Apr. 14, 1986, abandoned.

[51] Int. Cl.[5] ..... B65D 23/10

[52] U.S. Cl. ..... 215/1 C; 220/94 A; D9/383; D9/398; D9/405

[58] Field of Search ..... D9/390, 391, 396–399, D9/403–413, 375, 376, 378, 383; 215/1 C; 220/94 A, 71, 72

[56] References Cited

U.S. PATENT DOCUMENTS

| | | | |
|---|---|---|---|
| D. 190,528 | 6/1961 | Brandeis . | |
| D. 203,076 | 11/1965 | Adell . | |
| D. 203,883 | 2/1966 | Wood . | |
| D. 207,509 | 4/1967 | Thomka et al. | D9/376 X |
| D. 214,550 | 7/1969 | Plummer | D9/408 |
| D. 256,992 | 9/1980 | Kretz | D9/403 |
| D. 258,117 | 2/1981 | Bashour . | |
| D. 262,267 | 12/1981 | Cox . | |
| D. 277,551 | 2/1985 | Kerr . | |
| D. 279,167 | 6/1985 | Hanev et al. . | |
| D. 281,577 | 12/1985 | Larson et al. . | |
| D. 281,862 | 12/1985 | Bertrand . | |
| D. 282,349 | 1/1986 | Larson et al. . | |
| D. 292,378 | 10/1987 | Brandt et al. | D9/396 |
| 1,602,391 | 10/1926 | Creaver . | |
| 1,636,174 | 7/1927 | Dolan et al. . | |
| 2,022,520 | 11/1935 | Philbrick . | |
| 3,152,710 | 10/1964 | Platte | 215/1 R |
| 3,232,495 | 2/1966 | Schneider . | |
| 3,403,804 | 10/1968 | Colombo | D9/399 X |
| 3,536,500 | 10/1970 | Cleereman et al. . | |
| 3,537,498 | 11/1970 | Amand . | |
| 3,708,082 | 2/1973 | Platte | 220/99 A |
| 4,308,955 | 1/1982 | Schieser et al. . | |
| 4,351,454 | 9/1982 | Maynard, Jr. | D9/370 X |
| 4,372,455 | 2/1983 | Cochran . | |
| 4,387,816 | 6/1983 | Weckman | 215/1 C |

FOREIGN PATENT DOCUMENTS

| | | | |
|---|---|---|---|
| 13048/83 | 3/1983 | Australia . | |
| 570010 | 3/1988 | Australia . | |
| 571000 | 3/1988 | Australia . | |
| 0055595 | 7/1982 | European Pat. Off. . | |
| 934609 | 5/1948 | France . | |
| 1337902 | 12/1963 | France . | |
| 1507327 | 12/1967 | France . | |
| 2443915 | 12/1979 | France . | |
| 0033745 | 8/1981 | France . | |
| 380639 | 9/1964 | Switzerland | 220/94 A |
| 614859 | 12/1948 | United Kingdom . | |
| 856958 | 12/1960 | United Kingdom . | |
| 1024406 | 3/1966 | United Kingdom . | |
| 1024763 | 4/1966 | United Kingdom . | |
| 1059930 | 2/1967 | United Kingdom . | |
| 1207017 | 9/1970 | United Kingdom . | |

*Primary Examiner*—Bryon P. Gehman
*Attorney, Agent, or Firm*—Oliff & Berridge

[57] ABSTRACT

A blow-molded bottle-shaped container of biaxially oriented thermoplastic synthetic resin includes a pair of recesses depressed inwardly on the right and left side parts of a rear half portion substantially at the central height position of a cylindrical container body to form a grip to be grasped by one hand. The bottle-shaped container can enhance the buckling stiffness of an integrally molded grip by providing parallel grooves and/or reinforcing ribs in and around the grip.

2 Claims, 3 Drawing Sheets

BIAXIAL-ORIENTATION BLOW-MOLDED BOTTLE-SHAPED CONTAINER HAVING OPPOSED RECESSES AND GROOVES FOR STABLE GRIPPING AND ANTI-BUCKLING STIFFNESS

CROSS REFERENCE TO RELATED APPLICATION

This application is a continuation-in-part of U.S. Ser. No. 851,450 filed Apr. 14, 1986, now abandoned.

BACKGROUND OF THE INVENTION

This invention relates to a blow-molded bottle-shaped container of biaxially oriented synthetic resin such as polyethylene terephthalate resin. More particularly, the invention relates to a blow-molded bottle-shaped container having specially designed recesses and grooves to improve the stability and anti-buckling properties of the bottle when grasped.

Blow-molded bottle-shaped containers of biaxially oriented theremoplastic synthetic resin such as polyethylene terephthalate resin have been widely used. Since the bottle-shaped containers are blow-molded from biaxial-orientation synthetic resin, it is considerably difficult to integrally form a ring-shaped grip for grasping the bottle. The bottle must be associated with a grip made from another member such as cardboard or synthetic resin. However, the bottle-shaped containers of this type have disadvantages which complicate the manufacturing steps required for molding.

In order to obviate the difficulty in molding the bottle-shaped container of this type, a bottle-shaped container has been developed in which a pair of recesses are formed in parts of the body to construct a grip. Since the grip is molded together with the body at biaxial-orientation blow-molding time, the bottle-shaped container of this type can be readily molded to provide excellent holding or grasping effects. Unfortunately, the grip portion communicates with the body in a hollow state and the bottle-shaped container is thus blow-molded as a considerably thin walled body. Thus, the grip is easily deformed or buckled when the body is grasped by inserting fingers into both the recesses of the container body to hold the container body. Such deformation and buckling is exacerbated when the container is filled with liquid since the external pressure on the grip is increased to move the filled container.

SUMMARY OF THE INVENTION

Accordingly, it is an object of this invention to provide a blow-molded bottle-shaped container of biaxially oriented synthetic resin which can eliminate the drawbacks and disadvantages of the conventional bottle-shaped container with opposed recesses for the grip as described above and can enhance the buckling stiffness of a grip integrally molded in the bottle. The invention overcomes the prior art disadvantages by providing a grip by molding a pair of recesses with reinforcing ribs at the rear halves of the container body to strengthen the grip. Further, parallel circumferential grooves are provided above and below the recesses to increase rigidity and anti-buckling stiffness of the bottle. Circumferential grooves can also be placed in the grip area to extend between the recesses to imprve anti-buckling characteristics.

BRIEF DESCRIPTION OF THE DRAWINGS

The foregoing objects and other objects as well as the characteristic features of the invention will become more fully apparent and more readily understandable by the following description and the appended claims when read in conjunction with the accompanying drawings wherein:

DESCRIPTION OF THE PREFERRED EMBODIMENTS

Figure 1:
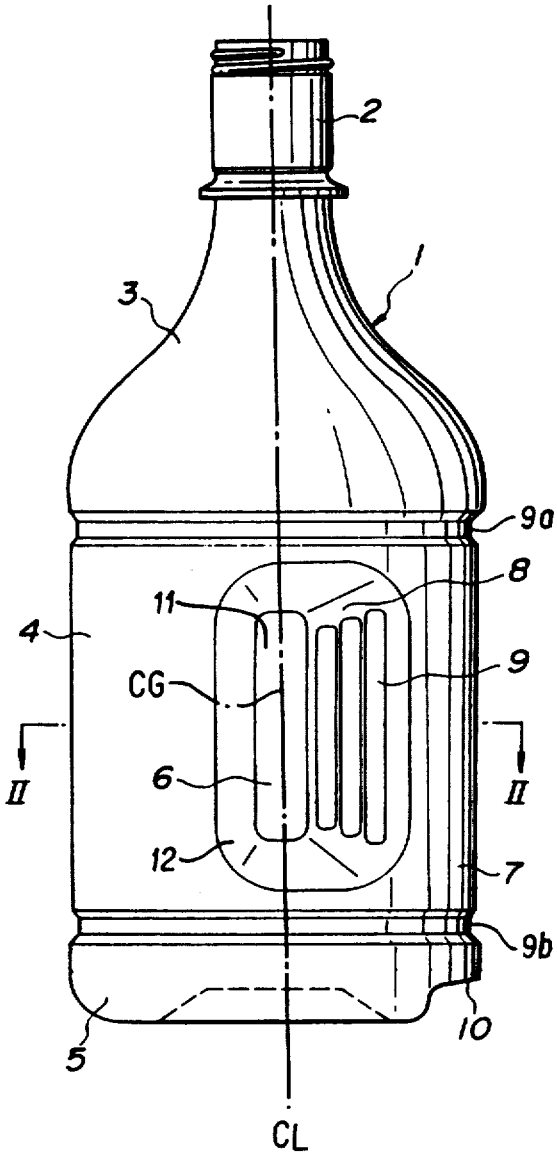
FIG. 1 is a side view of a bottle-shaped container showing a first embodiment of a blow-molded bottle-shaped container of biaxially oriented synthetic resin according to this invention.

As shown in FIG. 1, a blow-molded bottle-shaped container 1 of biaxially oriented polyethylene terehthalate resin is integrally molded with a cylindrical container body 4 between a shoulder 3 with a short cylindrical neck 2, and a bottom 5 formed at the lower end of the container body 4. The body 4 is molded together with a pair of recesses 6 depressed inwardly and oppositely at both the right and left sides of a rear half portion of the body 4. The recesses 6 are located substantially in the central height position of the body 4.

A grip 7 is molded at the rear half portion of the container body 4 by forming the pair of recesses 6 as described above, and the bottle-shaped container 1 can be held by grasping the grip 7 by disposing fingers in both the recesses 6 depressed inwardly at both the right and left sides of the rear half portions. Advantageously, the pair of recesses 6 for forming the grip 7 are disposed at the central position in such a shape for effectively and conveniently grasping the grip 7 by inserting the fingers of one hand into the recesses 6. More particularly, the recesses 6 must have an axial longitudinal length sufficient for disposing at least four fingers except a first finger (or thumb) and a shape sufficient for readily sustaining an external pressure force when the grip 7 is grasped by inserting the first finger into one recess 6 and the other four fingers into the other recess 6.

Figure 2:
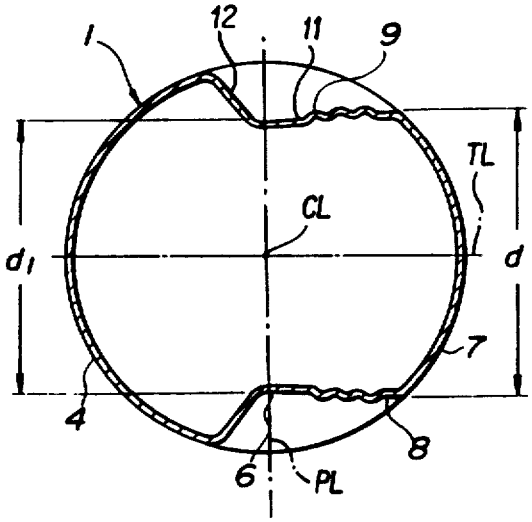
FIG. 2 is a sectional view taken along the line II—II of FIG. 1.
Figure 3:
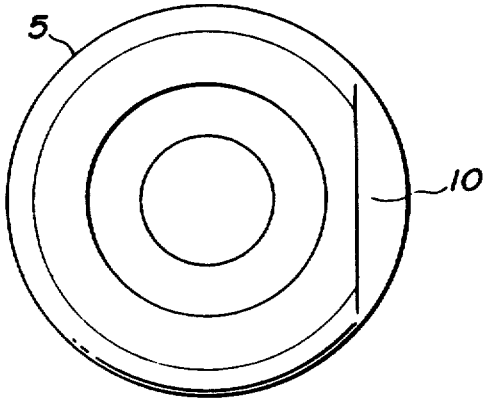
FIG. 3 is a plan view of FIG. 1.

As described above, and as shown in FIG. 2, tapered parts 8 of the recesses 6 are disposed oppositely with respect to the center line CL passing in the longitudinal direction of the container body 4. Moreover, the recesses 6 are disposed on opposite sides with respect to the transverse center line TL at the central height position. Since the recesses are located along the longitudinal center line CL and at the central height position, a low point or nadir area 11 of the recesses is aligned with the area which includes the center of gravity CG of the container which is located adjacent the intersection of the longitudinal center line CL and the transverse center line TL at the central height position. The front surfaces 12 extending forwardly from the nadir area 11 of the recesses are disposed forwardly of the tapered portions and forwardly of a perpendicular line PL intersecting the longitudinal center line CL thus aligning the recesses with the area containing the center of gravity of the container to increase the stability of the container when grasped.

The tapered parts 8 are inclined slightly inwardly from the rear end of the container body toward the center so that the interval between the both tapered parts 8 is set to a predetermined numerical value for readily grasping the grip 7. For example, assume that the numerical value of the interval between both tapered parts 8 at the rear end of the container body 4 is represented by d and the numerical value of the interval at the center of the container body 4 is represented by $d_1$. Both values always have a relationship of $d>d_1$ since the tapered parts 8 are inclined. The concrete numerical values d and $d_1$ are determined depending upon the shape of the bottle-shaped container 1 such a circular-sectional cylindrical shape or a square- or polygonal-sectional cylindrical shape, or the capacity of the container body. For example, in case of d=83 cm, $d_1$=77 cm, in case of d=88, $d_1$=84 cm, in case of d=77 cm, $d_1$=71 cm are experimentally obtained as desired intervals.

A plurality of longitudinal anti-slip strips 9 are formed on the tapered parts 8 so that the faces of the fingers may be readily engaged in case of grasping the grip 7. In addition, two parallel circumferential grooves **9*a*, 9*b* are respectively located above and below the recesses 6. The grooves 9*a*, 9*b* extend around the perimeter of the container body 4 and increase the overall rigidity of the bottle. In addition, the grooves 9*a*, 9*b* increase the buckling stiffness of the bottle when the recesses are grasped. That is, the grooves provide additional rigidity so that the grip 7 is unlikely to collapse (i.e., inward movement of the grip 7** so that $d<d_1$) under normally expected gripping pressure.

Further, a crescent-shaped notch 10 is formed at the rear end of the bottom 5 of the container body 4 perpendicularly to the transverse center line TL so as to always direct the grip 7 formed at the rear end in a predetermined direction in case of conveying the bottle-shaped container 1 via a conveyor. That is, the notch 10 is located directly below and aligned with the grip 7 so that a conveyor can orient several bottles into alignment by aligning the notches 10 so that the grips 7 of the aligned bottles face in the same direction.

Figure 4:
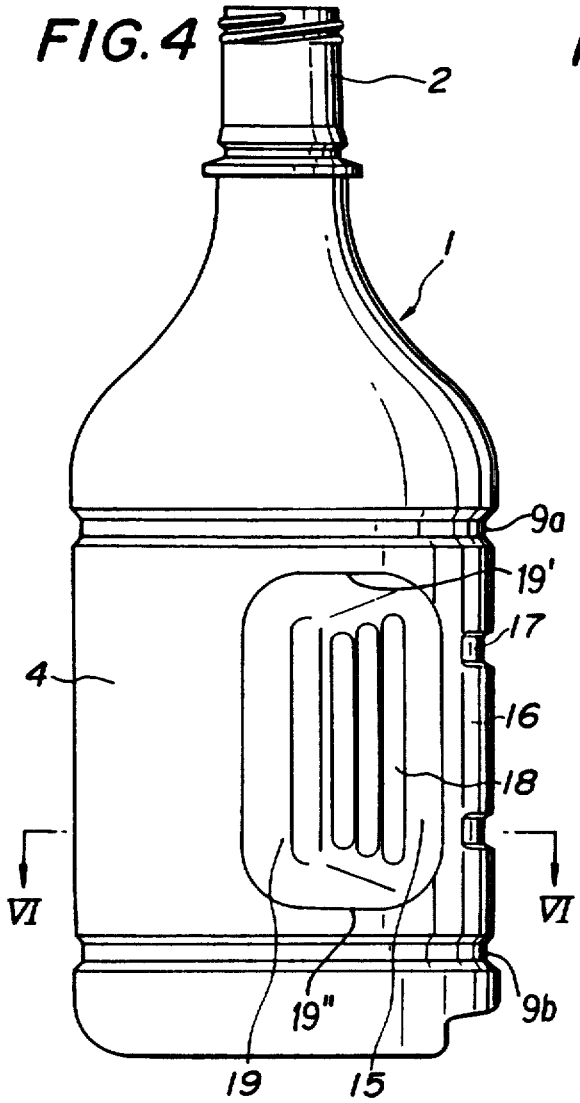
FIG. 4 is a side view of second embodiment of this invention.
Figure 5:
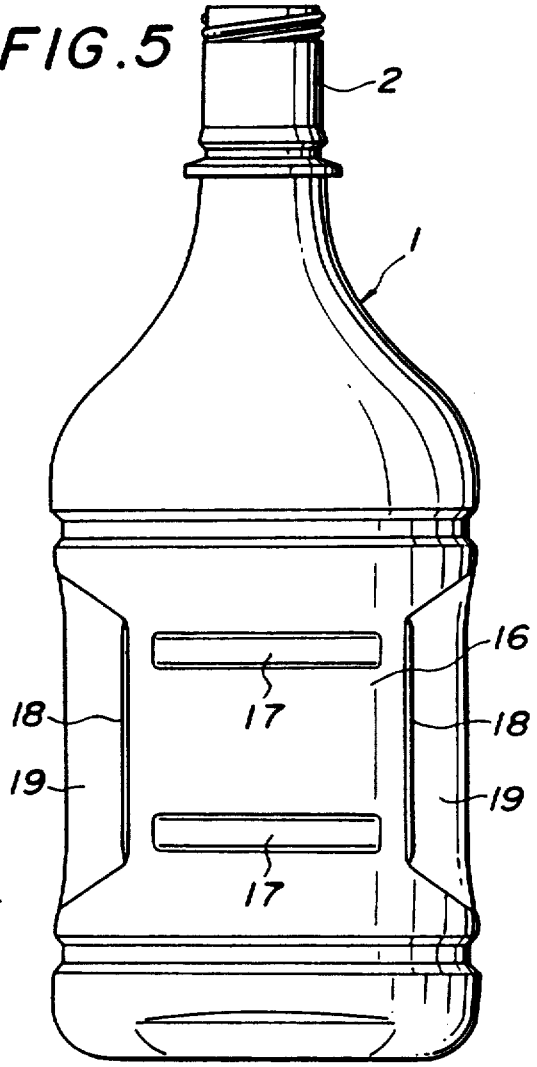
FIG. 5 is a rear view of the bottle-shaped container of FIG. 4.
Figure 6:
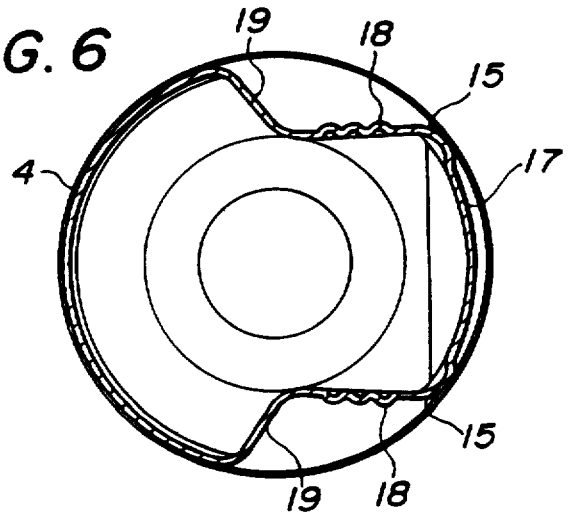
FIG. 6 is a sectional view taken along the line VI—VI of FIG. 4.

FIGS. 4 to 6 show a second embodiment of this invention. In the second embodiment, the bottle-shaped container 1 is molded in the same manner as the first embodiment, but a pair of relatively wide recesses 19 are formed on both sides of the container body in the same position as the less-wide recesses 6 of the first embodiment. The tapered parts 15 of the recesses 19 are opposed to each other to form a grip 16 at the rear of the container body 4 between the recesses 19. Further, upper and lower rib grooves 17 are formed circumferentially at the rear end of the grip 16, i.e., on the peripheral surface of the container body 4 for forming the grip 16. The rib grooves 17 are located between the upper and lower limits 19', 19'' of the recesses 19 and extend between the tapered parts 15 of the opposing recesses. The rib grooves 17 add rigidity and stiffness directly to the area defining the grip 16 to reduce the likelihood of buckling when the bottle is grasped. The tapered parts 15 of the recesses 19 are opposed substantially in parallel in such a manner that the interval at the center is slightly smaller than the interval at the rear. A plurality of longitudinal anti-slip strips 18 are formed on the tapered parts 15.

Thus, since the rib grooves 17 are formed on the rear end of the grip 16 which in turn is formed by oppositely forming a pair of recesses 19 on parts of the container body 4, the tapered parts 15 are not inwardly collapsed or deformed even if the grip 16 is grasped by the fingers thus eliminating the external swelling deformation of the rear end of the container body upon grasping. Further, since the tapered parts 15 are narrowed at the interval at the center as compared with the interval at the rear end, the tapered parts 15 are inclined from the rear end toward the center. Thus, the grip 16 may be easibly grasped by the fingers. As described above, since the rear end of the grip 16 is formed to resist deformation even if pressures are applied from both sides, the interval between the rear ends of the tapered parts 15 is not narrowed, and the inclined shape of the tapered parts 15 is maintained.

Figure 7:
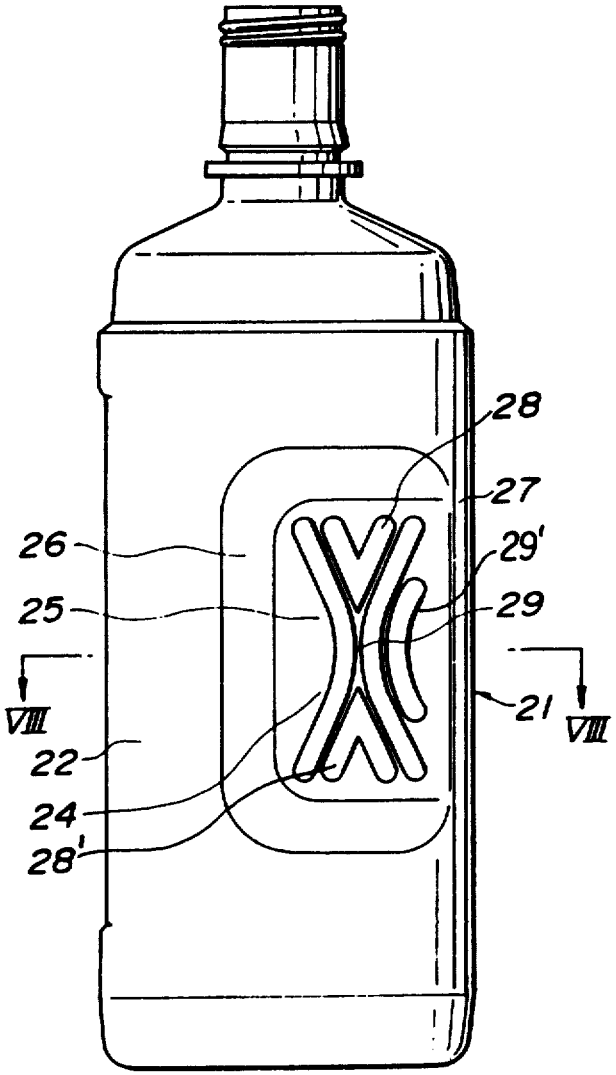
FIG. 7 is a side view of a third embodiment of this invention.
Figure 8:
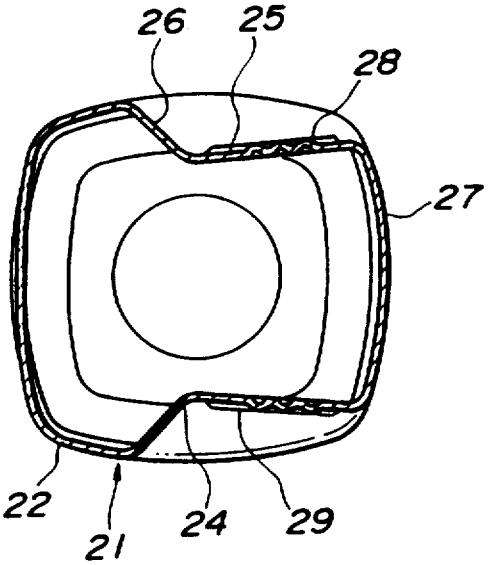
FIG. 8 is a sectional view taken along the line VIII—VIII of FIG. 7.

FIGS. 7 and 8 show a third embodiment of the invention. A bottle-shaped container 21 of this embodiment is molded with recesses 24 formed on both sides of a cylindrical container body 22 in generally the same location as the recesses of the first embodiment. The recesses 24 are formed with tapered front walls 26 inclined toward the less tapered rear walls to form a grip 27 at the rear of the container body 22. The less tapered rear walls 25 of both recesses 24 are provided with substantially X-shape projections over the entire height and entire width of the less tapered walls 25 to form reinforcing ribs 29. The X-shape projection 29 form anti-slip strips as well as increase resistance against the gripping pressure applied to the less tapered walls 25. V-shaped rib strips 28 and inverted V-shaped rib strips 28' also project along the upper and lower parts of the X-shaped reinforcing rib. Further, partial arc-shaped rib strips 29' project along the sides of the X-shaped ribs 29 at the rear of the tapered rear walls 25 of the recesses 24. The V-shaped and arc-shaped ribs 28, 28', 29' and the ribs 29 further aid reinforcing of the less tapered rear wall 25 of the recesses 24. The ribs 28, 28', 29, 29' increase the resistance of the tapered rear walls 25 to collapse or buckling by stiffening the recesses.

While the first, second and third embodiments are described above separately, those skilled in the art recognize that the features of any one embodiment can be incorporated with the features of one or both of the other embodiments.

According to the present invention as described above, the bottle-shaped container of this invention can be much more stably grasped by the fingers since recesses are aligned with the center of gravity and the likelihood of buckling is reduced by providing grooves and/or reinforcing ribs. The reinforcing ribs also resist the internal and external pressures acting on the recesses if the bottle-shaped container is dropped when filled with liquid, thus causing the internal pressure to rise in the container and act against the recesses. Further, if the grip is grasped with increased force because the bottle is filled with liquid, thus applying external pressure to the recesses, the recesses are not inwardly bent, deformed or collapsed. Thus, the mechanical strength of the entire bottle-shaped container can be remarkably increased. Since the grip is molded integrally with the bottle-shaped container, relatively large bottle-shaped containers can be readily handled. Since the construction of the bottle-shaped container is simple as described above, the molding of the container is not complicated but can be performed simply as in the conventional methods.

What is claimed is:

1. A blow-molded bottle-shaped container of biaxially oriented thermoplastic synthetic resin comprising:

a cylindrical container body defining a longitudinal center line and having a shoulder and neck portion at an upper end thereof and a bottom portion at a lower end thereof;

a pair of recesses depressed inwardly on opposite sides of a rear half portion of the cylindrical container body substantially at a central height position of the cylindrical container body to form a grip to be grasped by one hand, said recesses including tapered parts disposed oppositely with respect to the longitudinal center line and having inclined surfaces substantially inclined in a direction from the rear half portion of said container body toward a center thereof, said recesses having a nadir area aligned with an area including a point defining the center of gravity of said container;

a pair of parallel upper and lower circumferential reinforcing grooves extending around an exterior peripheral surface of said cylindrical container body, said upper circumferential groove being located between said shoulder and neck portion and said recesses, and said lower circumferential groove being located between said bottom portion and said recesses;

a notch formed in the bottom portion at the rear half portion of the cylindrical container body and circumferentially extending between the recesses; and a pair of parallel upper and lower circumferential reinforcing rib grooves located entirely in the grip between upper and lower limits of the recesses and extending between the tapered part of one recess and the tapered part of the opposite recess without extending into the recesses.

2. A blow-molded bottle-shaped container of biaxially oriented thermoplastic synthetic resin comprising:

a cylindrical container body defining a longitudinal center line and having a shoulder and neck portion at an upper end thereof and a bottom portion at a lower end thereof;

a pair of recesses depressed inwardly on opposite sides of a rear half portion of the cylindrical container body substantially at a central height position of the cylindrical container body to form a grip to be grasped by one hand, said recesses including tapered parts disposed oppositely with respect to the longitudinal center line and having inclined surfaces substantially inclined in a direction from the rear half portion of said container body towards center thereof, said recesses having a nadir area aligned with an area including a point defining the center of gravity of said container; and a pair of parallel upper and lower circumferential reinforcing rib grooves located entirely in the grip between upper and lower limits of the recesses, and extending between the tapered part of one recess and the tapered part of the opposite recess without extending into the recesses.

* * * * *